US009660380B1

(12) United States Patent
McCracken et al.

(10) Patent No.: US 9,660,380 B1
(45) Date of Patent: May 23, 2017

(54) ALIGNMENT TOLERANT ELECTRONIC CONNECTOR

(71) Applicant: Microsoft Technology Licensing, LLC, Redmond, WA (US)

(72) Inventors: Ivan Andrew McCracken, Sammamish, WA (US); Kanth Kurumaddali, Bellevue, WA (US); Kenneth Charles Boman, Duvall, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 0 days.

(21) Appl. No.: 15/004,691

(22) Filed: Jan. 22, 2016

(51) Int. Cl.
*H01R 13/64* (2006.01)
*H01R 13/631* (2006.01)

(52) U.S. Cl.
CPC ..... *H01R 13/6315* (2013.01)

(58) Field of Classification Search
CPC ..... H01R 13/6315
USPC ..... 439/248
See application file for complete search history.

(56) References Cited

U.S. PATENT DOCUMENTS 2,749,526 A 6/1956 Peterson
3,264,601 A 8/1966 Hartholz
3,553,633 A 1/1971 Ondrejka
3,696,319 A 10/1972 Olsson
3,703,615 A 11/1972 Vogt
4,131,378 A 12/1978 Daws
4,179,179 A 12/1979 Lowden
4,421,371 A 12/1983 Clark et al.
4,537,459 A 8/1985 Brennan et al.
4,640,570 A 2/1987 Strate
4,687,267 A 8/1987 Header et al.
4,824,383 A 4/1989 Lemke
5,176,530 A 1/1993 Reylek et al.
5,383,790 A 1/1995 Kerek et al.
5,409,403 A 4/1995 Falossi et al.
5,431,577 A * 7/1995 Lincoln ..... H01R 13/6315 439/248

(Continued)

FOREIGN PATENT DOCUMENTS

DE 4331280 C1 9/1994
JP H04317899 A 11/1992

(Continued)

OTHER PUBLICATIONS

Ingle, P. et al., "Super Speed Data Traveller USB 3.0," International Journal of Computer Science and Applications, vol. 6, No. 2, Apr. 2013, 9 pages.

(Continued)

*Primary Examiner* — Javid Nasri
(74) *Attorney, Agent, or Firm* — Alleman Hall Creasman & Tuttle LLP

(57) ABSTRACT

An electronic connector includes a base and a tapered extension. The tapered extension includes a platform and a plurality of electrical contacts. An alignment tolerant joint couples the tapered extension to the base, such that the tapered extension is movable relative to the base in three orthogonal dimensions responsive to an external force applied to the tapered extension. One or more biasing components bias the tapered extension away from the base.

18 Claims, 11 Drawing Sheets

(56) References Cited

U.S. PATENT DOCUMENTS

| | | | |
|---|---|---|---|
| 5,510,957 | A | 4/1996 | Takagi |
| 5,552,959 | A | 9/1996 | Penniman et al. |
| RE35,508 | E | 5/1997 | Lemke et al. |
| 5,664,953 | A | 9/1997 | Reylek |
| 6,042,391 | A | 3/2000 | Bodo et al. |
| 6,074,225 | A | 6/2000 | Wu et al. |
| 6,280,209 | B1 | 8/2001 | Bassler et al. |
| 6,322,372 | B1 | 11/2001 | Sato |
| 6,565,363 | B2 | 5/2003 | Downing |
| 6,583,985 | B2 | 6/2003 | Nguyen et al. |
| 6,590,658 | B2 | 7/2003 | Case et al. |
| 6,771,494 | B2 | 8/2004 | Shimano |
| 6,781,819 | B2 | 8/2004 | Yang et al. |
| 6,786,755 | B2 | 9/2004 | Dambach et al. |
| 6,845,005 | B2 | 1/2005 | Shimano et al. |
| 6,944,012 | B2 | 9/2005 | Doczy et al. |
| 7,331,793 | B2 | 2/2008 | Hernandez et al. |
| 7,541,907 | B2 | 6/2009 | Wang et al. |
| 7,573,225 | B2 | 8/2009 | Ebihara |
| 7,628,628 | B2 | 12/2009 | Matsuda et al. |
| 7,643,144 | B2 | 1/2010 | Okamuro et al. |
| 7,758,379 | B2 | 7/2010 | Chen |
| 7,815,450 | B1 | 10/2010 | Chen et al. |
| 7,837,499 | B1 | 11/2010 | Chen |
| 7,841,776 | B2 | 11/2010 | DiFonzo et al. |
| 8,092,261 | B2 | 1/2012 | Lord |
| 8,147,277 | B1 | 4/2012 | Wang et al. |
| 8,342,857 | B2 | 1/2013 | Palli et al. |
| 8,506,332 | B2 | 8/2013 | Sommers et al. |
| 8,596,881 | B2 | 12/2013 | Umeno |
| 8,721,356 | B2 | 5/2014 | Webb et al. |
| 8,780,541 | B2 | 7/2014 | Whitt, III et al. |
| 8,821,194 | B2 | 9/2014 | Shih et al. |
| 8,827,331 | B2 | 9/2014 | Corcoran et al. |
| 8,888,688 | B2 | 11/2014 | Julian et al. |
| 8,947,861 | B2 | 2/2015 | Staats et al. |
| 9,017,092 | B1 | 4/2015 | McCracken et al. |
| 9,069,527 | B2 | 6/2015 | Leong et al. |
| 9,075,566 | B2 | 7/2015 | Whitt, III et al. |
| 9,178,316 | B1 | 11/2015 | McCracken et al. |
| 9,426,905 | B2 | 8/2016 | Bathiche et al. |
| 2001/0053624 | A1 | 12/2001 | Medina et al. |
| 2004/0229502 | A1 | 11/2004 | Hu et al. |
| 2007/0053695 | A1 | 3/2007 | Margaritis |
| 2008/0127684 | A1 | 6/2008 | Rudduck et al. |
| 2009/0088024 | A1 | 4/2009 | Ling et al. |
| 2009/0117784 | A1 | 5/2009 | Wu |
| 2009/0318026 | A1 | 12/2009 | Yi et al. |
| 2011/0261509 | A1 | 10/2011 | Xu et al. |
| 2012/0015561 | A1 | 1/2012 | Tsai |
| 2012/0177324 | A1 | 7/2012 | Schwandt et al. |
| 2012/0200173 | A1 | 8/2012 | Liu et al. |
| 2012/0224316 | A1 | 9/2012 | Shulenberger |
| 2013/0021738 | A1 | 1/2013 | Yang et al. |
| 2013/0040470 | A1 | 2/2013 | Gao et al. |
| 2013/0115814 | A1 | 5/2013 | Briant et al. |
| 2013/0171885 | A1 | 7/2013 | Zhang |
| 2013/0217260 | A1 | 8/2013 | Nichol et al. |
| 2013/0273752 | A1 | 10/2013 | Rudisill et al. |
| 2013/0332642 | A1 | 12/2013 | Capezza |
| 2014/0130316 | A1 | 5/2014 | Rudduck et al. |
| 2014/0132550 | A1 | 5/2014 | McCracken et al. |
| 2014/0347802 | A1 | 11/2014 | Lee |
| 2014/0362509 | A1 | 12/2014 | Lin |
| 2015/0116926 | A1 | 4/2015 | Robinson et al. |
| 2015/0277491 | A1 | 10/2015 | Browning et al. |
| 2015/0325953 | A1 | 11/2015 | McCracken et al. |
| 2016/0044800 | A1 | 2/2016 | Jarvis et al. |

FOREIGN PATENT DOCUMENTS

| | | | |
|---|---|---|---|
| WO | 2010065569 | A2 | 6/2010 |
| WO | 2011163260 | A1 | 12/2011 |
| WO | 2014164889 | A2 | 10/2014 |
| WO | 2015171441 | A1 | 11/2015 |

OTHER PUBLICATIONS

Zhou, S. et al., "Signal Integrity Analysis of High-Speed Signal Connector USB3.0," Advanced Materials Research, vols. 760-762, Sep. 2013, 6 pages.

ISA European Patent Office, International Search Report and Written Opinion Issued in Application No. PCT/US2015/028681, Aug. 20, 2015, WIPO, 11 pages.

State Intellectual Property Office of the People's Republic of China, Notice of Allowance Issued in Chinese Patent Application No. 201210388564.8, Oct. 10, 2015, 4 pages.

Kessler, Derek., "Acer debuts the Aspire Switch 10, a convertible, detachable tablet", Published on: Apr. 29, 2014 Available at: http://www.windowscentral.com/acer-debuts-aspire-switch-10-convertible-tablet.

Purcher, Jack., "Finally! Apple Reveals their Hybrid Notebook Tablet Details", Published on: Apr. 4, 2013 Available at: http://www.patentlyapple.com/patently-apple/2013/04/finally-apple-reveals-their-hybrid-notebook-tablet-details.html.

Hollister, Sean, "Lenovo ThinkPad Helix Tablet / Laptop Hybrid gets a Power-Up when it Docks", Published on: Jan. 6, 2013, Available at: http://www.theverge.com/2013/1/6/3844010/lenovo-thinkpad-helix-convertible.

Mitchell, J., "What is Optical Alignment?," Proceedings of the 3rd Turbomachinery Symposium, Available as Early as Jan. 1, 1974, Texas, 6 pages.

* cited by examiner

ALIGNMENT TOLERANT ELECTRONIC CONNECTOR

BACKGROUND

Electronic devices often include hardware interfaces in the form of electronic connectors for exchanging electrical power, a ground reference, and/or communication signals with external systems.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

An electronic connector includes a base and a tapered extension. The tapered extension includes a platform and a plurality of electrical contacts. An alignment tolerant joint couples the tapered extension to the base, such that the tapered extension is movable relative to the base in three orthogonal dimensions responsive to an external force applied to the tapered extension. One or more biasing components bias the tapered extension away from the base.

DETAILED DESCRIPTION

When two devices are attached using an electronic connector, it is generally important that the two devices be properly aligned, so as to ensure a proper connection. Problems with alignment can result in connectivity issues between connected devices, and can even cause physical damage to one or more of the devices. Accordingly, when connecting two devices, it may in some cases be desirable to utilize an electronic connector which is movable in one or more dimensions, allowing for more alignment-tolerance. As discussed in more detail below, an alignment tolerant electronic connector may include a tapered extension which is removably insertable into a female receptacle. The tapered extension may be coupled to a base via an alignment tolerant joint, such that the tapered extension is movable relative to the base in three orthogonal dimensions when an external force is applied to the tapered extension. For example, a user may attempt to insert the tapered extension into a female receptacle while the tapered extension is slightly offset from the female receptacle. During insertion, the female receptacle may exert a force on the misaligned tapered extension, causing it to move relative to the base until it is properly aligned with the female receptacle. The alignment tolerant joint may include a variety of movement-facilitating components which allow for the alignment-tolerance of the electronic connector. The alignment tolerant joint may further include one or more biasing components which bias the tapered extension away from the base.

Figure 1:
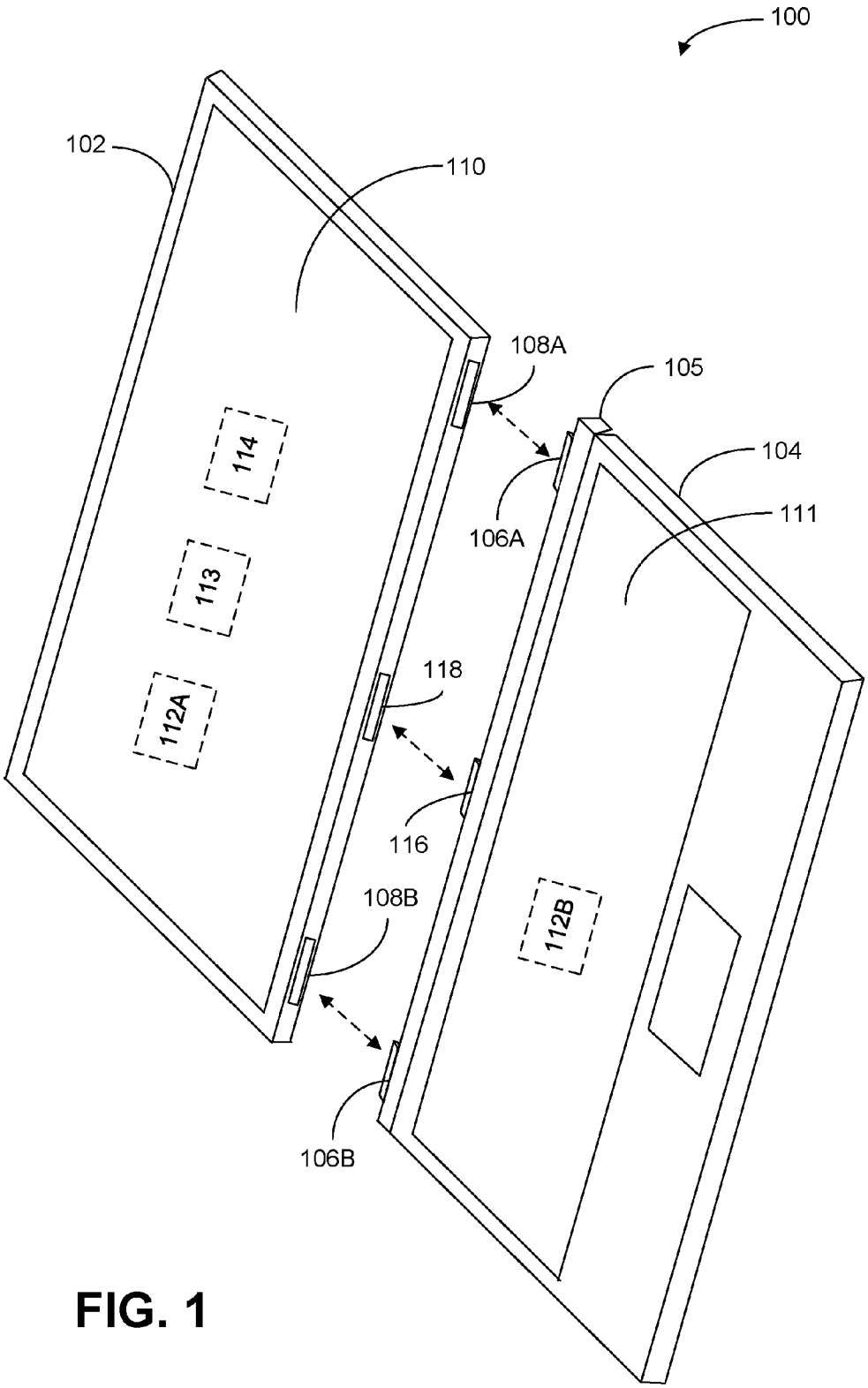
FIG. 1 schematically shows an example computing device including two separable portions.

FIG. 1 schematically shows an example computing device 100 comprising two separable portions: first portion 102 and second portion 104. The first portion 102 may be separably connected to the second portion 104 by a locking mechanism. For example, the first portion 102 may be mechanically connected to the second portion 104 in a docked (and/or locked) configuration. In the docked configuration, the first computing device 100 may assume a form-factor similar to a laptop computer, where an angle between first portion 102 and second portion 104 is adjustable via manipulation of a hinge 105. Responsive to user input, computing device 100 may transition from the docked configuration to an undocked configuration, such as the undocked configuration shown in FIG. 1. The locking mechanism may include one or more locking protrusions 106 and one or more locking receptacles 108, as shown in FIG. 1.

The first portion 102 may include a display 110. The display 110 may be a touch sensitive display screen. The second portion 104 may include an input device 111. The input device 111 may include a keyboard, touchpad, one or more buttons, other input devices, or combinations thereof that may be used to provide input to the computing device 100. Although a hybrid computing device is shown, alignment tolerant electronic connectors may be used with other computing devices where two portions are separably connected together. For example, the first portion 102 may be a mobile phone and the second portion 104 may be a cover, a keyboard, or other device. Further, alignment tolerant electronic connectors may be used in recharging cables, docking stations, wall outlets, and/or other power/data connectors.

The first portion 102 and/or the second portion 104 may include a processor 112, memory 113, a battery 114, other computing components, or combinations thereof. For example, as shown, the first portion 102 may include a processor 112A, memory 113, and a battery 114 while the second portion 104 may also include a processor 112B. In some implementations, only one of the first portion 102 or the second portion 104 may include a processor 112. In other implementations, both of the first portion 102 and the second portion 104 include a processor 112. In general, one or more computing components (e.g., processors 112, memory 113, and battery 114) may be included in the first portion 102 and/or the second portion 104 in any combination.

The computing components in the second portion 104 may be in electronic communication with one or more of the computing components in the first portion 102. For example, as shown in FIG. 1, the first portion 102 and the second portion 104 may be in electronic communication via a physical electrical connector that includes a tapered extension 116 and a female receptacle 118. Though FIG. 1 only shows one tapered extension 116 and one female receptacle 118, a computing device 100 may utilize any number of tapered extensions and female receptacles in order to facilitate electronic communication between the first and second portions. For example, in some implementations, a computing device 100 may use three tapered extensions, insertable into three different female receptacles.

Although FIG. 1 illustrates the display 110 of the first portion 102 and the input device 111 of the second portion 104 as facing each other (e.g., both being on the front side of their respective portions), in some implementations, the first portion 102 and second portion 104 may be reversible. For example, the first portion 102 may connect to the second portion 104 as shown (e.g., with the display 110 facing the front) and may be undocked, rotated 180 degrees, and docked to the second portion 104 such that the first portion 102 faces the opposite direction (e.g., with the display 110 facing the back). Thus, the electronic connector, including the tapered extension 116 and the female receptacle 118 may be configured to allow a reversible connection between the first portion 102 and the second portion 104.

As shown in FIG. 1, tapered extension 116 is located on the second portion 104 and female receptacle 118 is located on the first portion 102. In other implementations, one or more female receptacles 118 may be located on the second portion 104 and one or more tapered extensions 116 may be located on the first portion 102. In further implementations, the first portion 102 and the second portion 104 may include one or more tapered extensions 116 and one or more female receptacles 118, such that each of the first portion 102 and second portion 104 may include a combination of tapered extensions and female receptacles.

In implementations where computing components (e.g., the processor 112, memory 113, or battery 114) are on separate portions (e.g., first portion 102 and second portion 104), maintaining electrical communication between the first portion 102 and the second portion 104 may be important. For example, if a computing component on the second portion 104 were to lose electrical communication with an electrical component on the first portion 102, the computing device 100 may lose power and/or otherwise fail (e.g., an operating system may crash or a computing component may be affected by a power surge when the electrical connection is restored). Some electrical connections may be sensitive (e.g., high speed). The quality of a connection between first portion 102 and second portion 104 may be dependent upon a relative alignment between the one or more tapered extensions and the one or more female receptacles into which they are inserted. Accordingly, it may be desirable to utilize an electronic connector with some degree of alignment-tolerance, as will be described below.

Figure 2:
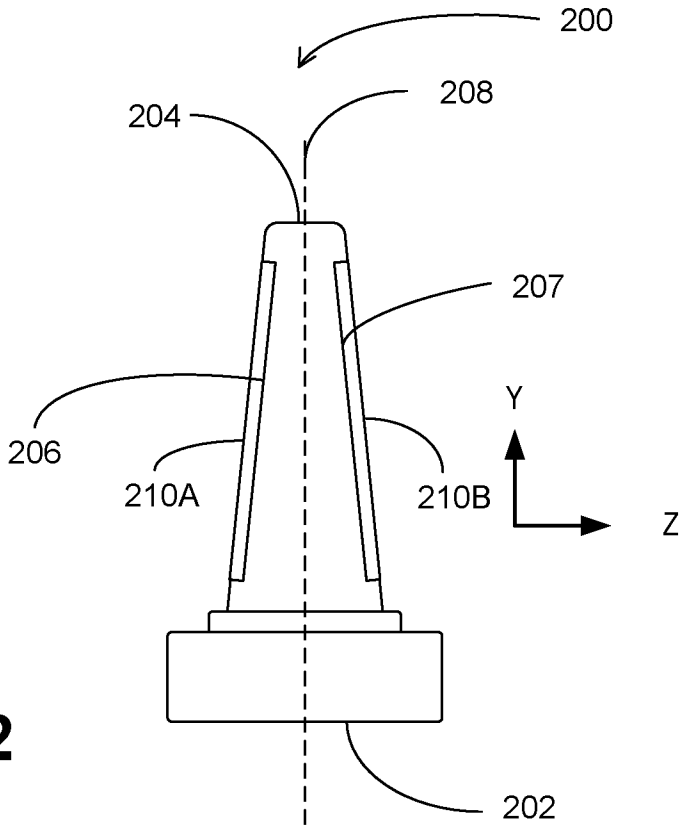
FIG. 2 depicts an example tapered extension of an alignment tolerant electronic connector viewed along an X coordinate axis.

FIG. 2 depicts an example tapered extension 200 of an alignment tolerant electronic connector, as viewed along an X-coordinate axis. Tapered extension 200 may represent a non-limiting example of tapered extension 116 of FIG. 1 when viewed along the X-coordinate axis.

Tapered extension 200 protrudes from a platform 202 along the Y-coordinate axis. Tapered extension 200 includes a nose 204 forming a terminal end of tapered extension 200. A first connection face 206 and a second connection face 207 form respective opposing sides of tapered extension 200 that taper toward each other from platform 202 to nose 204.

Each of first connection face 206 and second connection face 207 are inclined at an angle relative to the XY-coordinate plane. In an example, this angle may have a magnitude of 4 degrees. In another example, this angle may have a magnitude selected from the range of 3 degrees-5 degrees. In yet another example, this angle may have a magnitude selected from the range of 1 degree-10 degrees. In still further examples, this angle may have a magnitude selected from the range of >0 degrees-45 degrees. In still further examples, this angle may have a magnitude of zero to provide parallel opposing faces of a tapered extension or connection fang. In still further examples, first connection face 206 and second connection face 207 may be inclined at angles having different magnitudes relative to the XY-coordinate plane.

In at least some examples, a smaller angle relative to the Y-coordinate axis (i.e., the connection axis in this example) may advantageously provide greater connection depth and/or connector retention by a female receptacle, while a larger angle relative to the Y-coordinate axis may advantageously reduce connector depth and/or assist in connector mating with a female receptacle. A smaller angle may also allow for a relatively smaller opening in the Z-coordinate direction of a corresponding female receptacle, thus increasing options for small device size and/or female receptacle placement.

Tapered extension 200 may be symmetric about an XY-coordinate plane. As depicted in FIG. 2, tapered extension 200 is symmetric about a symmetry plane 208 of the XY-coordinate plane that passes through tapered extension 200. Symmetry plane 208 is parallel to the Y-coordinate axis, and passes through tapered extension 200 and between the first and second connection faces. Symmetry about the XY-coordinate plane may enable tapered extension 200 to be reversible between two orientations when mated with a female receptacle.

Further, tapered extension 200 may include a plurality of electrical contacts 210. In some implementations, a first set 210A of the plurality of electrical contacts may be located along first connection face 206, while a second set 210B of the plurality of electrical contacts may be located along second connection face 207. Electrical contacts 210 may be configured to interface with one or more electrical contacts of a female receptacle, such as female receptacle 118, into which tapered extension 200 is inserted. This may allow two connected devices to exchange electrical power, a ground reference, communication signals, etc.

FIGS. 3A-3E schematically show an example alignment tolerant electronic connector 300. Components shown in FIGS. 3A-3E may not be drawn to scale. FIGS. 3A-3E are only intended to illustrate the general relationships between components of an example alignment tolerant electronic connector. Electronic connector 300 includes a tapered extension 302, which includes a platform 304. Tapered extension 302 may represent a non-limiting example of tapered extension 116 from FIG. 1 and/or tapered extension 200 from FIG. 2.

Figure 3A:
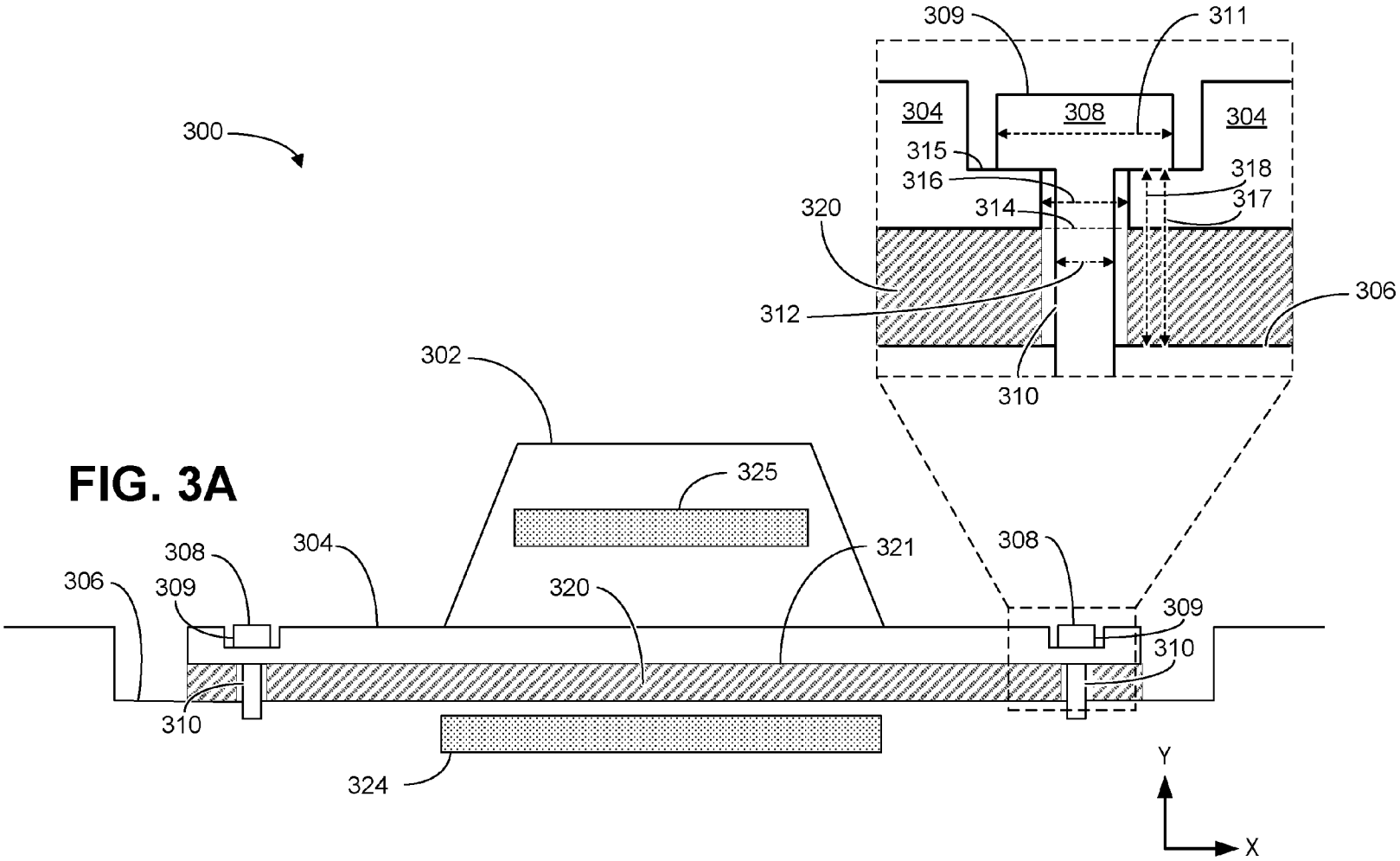
FIGS. 3A-3C schematically show an example alignment tolerant electronic connector viewed along a Z coordinate axis.

Tapered extension 302 is coupled to a base 306 via an alignment tolerant joint. In this example, the alignment tolerant joint includes two fasteners 308 affixing platform 304 to base 306. Each fastener 308 has a fastener head 309 and a fastener body 310. Each fastener head 309 has a latitudinal cross-sectional area, represented by dashed arrow 311 in FIG. 3A, and each fastener body has a latitudinal cross-sectional area, represented by dashed arrow 312 in FIG. 3A. As shown in FIG. 3A, each fastener head 309 has a latitudinal cross-sectional area greater than the latitudinal cross-sectional area of each fastener body 310.

Only one tapered extension 302 is shown in FIG. 3A. However, in some examples multiple tapered extensions may each share a common platform 304, affixed to base 306 via fasteners 308. In such examples, movement of the platform may result in equal movement of each tapered extension sharing the platform. Additionally or alternatively, a computing device, such as computing device 100, may utilize a number of alignment tolerant electronic connectors, such as electronic connector 300, each electronic connector having at least one tapered extension which is coupled to a base via an alignment tolerant joint.

In some implementations, other fasteners besides fasteners 308 may be used to affix a tapered extension to a base. For example, a base could be constructed which has a recess which is partially occluded by one or more shelves. A tapered extension including a platform could be partially disposed within the recess, though sized such that it cannot pass the shelves occluding the recess. In such an implementation, the shelves may serve as fasteners. Alternatively, an implementation could utilize similar fasteners to fasteners 308, though flipped such that each fastener body is inserted into platform 306, and each fastener head is inserted into a recess in the base defined by a catch. Other implementations may utilize one or more hooks, posts, screws, bolts, etc. In general, virtually any combination of structures, fasteners, mechanisms, and/or other features may be included in an alignment tolerant joint to movably affix a tapered extension to a base.

In FIG. 3A, platform 304 includes fastener apertures 314, through which fasteners 308 are inserted. Each fastener aperture is defined by a catch 315 in the platform 304, and has an opening area 316 which is greater than the latitudinal cross-sectional area of each fastener body 310 and smaller than the latitudinal cross-sectional area of each fastener head 309. Because each opening area 316 is greater than the latitudinal cross-sectional area of each fastener body 310 inserted through each opening area, platform 304, as well as the rest of tapered extension 302, may be movable relative to the base and fastener 308 in one or more latitudinal dimensions (e.g., an X axis and/or a Z axis) perpendicular to a longitudinal axis (e.g., a Y axis) of each fastener body.

As shown in FIG. 3A, the distance between the base 306 and each fastener head is represented by dashed arrow 317, and the distance between the base and each catch 315 is represented by dashed arrow 318. In FIG. 3A, dashed arrows 317 and 318 are approximately the same length. Biasing component 320 may be compressible in a longitudinal dimension parallel to a longitudinal axis of each fastener body. As a result, an external force applied to the tapered extension along a longitudinal axis toward the base may cause the tapered extension to move toward the base in the longitudinal dimension. Responsive to this movement, the distance between the base and each catch 315 may be less than the distance between the base and each fastener head 309. Accordingly, platform 314, as well as the rest of tapered extension 302, may be movable relative to the base 306 and fastener 308 in the longitudinal dimension responsive to application of an external force applied along the longitudinal axis. In FIG. 3A, the longitudinal axis is labeled as the Y axis.

As shown, electronic connector 300 includes biasing component 320. Platform 304 may interface with biasing component 320 via a movement-facilitating component 321, which may take the form of a low-friction surface of the biasing component, allowing the platform to move in one or more latitudinal dimensions relative to the movement facilitating component (e.g., along X axis and/or Z axis). The biasing component may be compressible in a longitudinal dimension parallel to a longitudinal axis of each fastener body (e.g., along the Y axis), and generate a biasing force which biases tapered extension 302 away from base 306. The biasing component may be composed of a synthetic foam material with spring-like properties. For example, the biasing component may be composed of a closed-cell urethane or silicone foam, though other materials may instead be utilized. Alternatively, the biasing component may be a magnet, and/or include one or more magnetic components configured to repel one or more magnets located within the tapered extension, thereby generating the biasing force. The biasing component may be composed of a material which naturally has a low coefficient of friction, thus independently functioning as a movement-facilitating component, and/or the biasing component may cooperate with one or more additional substances in order to provide the movement-facilitating component 321 that contacts platform 304. For example, the biasing component may be coated in a plastic film which has a low coefficient of friction.

In other implementations, multiple biasing components may be utilized. For example, an alternate alignment tolerant electronic connector may include one or more springs which serve as biasing components, as will be described in greater detail with respect to FIG. 6. In some implementations, rollers and/or ball bearings may be used as movement-facilitating components. An alignment tolerant joint may use virtually any components and/or combinations of materials in order to allow a tapered extension to move within a limited range relative to a base.

In some implementations, the distance between base 306 and each fastener head 310 may limit an extent to which the tapered extension 302 may be biased away from base 306. For example, when tapered extension 302 is fully biased, each catch 315 may contact each fastener head 309, preventing the tapered extension 302 from moving further away from base 306. In such implementations, the distance between base 306 and each fastener head 309, represented by dashed arrow 317, may be substantially equal to the distance between base 306 and each catch 315, represented by dashed arrow 318, when tapered extension 302 is fully biased. However, when an external force is applied to tapered extension 302, overcoming the biasing force and moving the tapered extension closer to the base, distance 318 may be shorter than distance 317.

In addition or as an alternative to biasing component 320, the alignment tolerant joint shown in FIGS. 3A-3E may include biasing components in the form of magnet 324, located within base 306, and magnet 325, located within tapered extension 302. Magnets 324 and 325 may be aligned such that they repel one another, thereby generating a repulsive force which biases the tapered extension away from the base. In some examples, magnet 324 may not be present, and instead biasing component 320 may be a magnet and/or include one or more magnetic components configured to repel a magnet located within the tapered extension. Application of an external force, such as external force 322, to the tapered extension may overcome the biasing force provided by magnetic repulsion, causing the tapered extension to move in the longitudinal dimension.

As described above, the one or more biasing components and movement-facilitating components, as well as the relationships between the base, platform, and fasteners, may allow the tapered extension to move relative to the base in three orthogonal dimensions relative to the base. In some implementations, movement of the tapered extension relative to the base may only occur responsive to an external force applied to the tapered extension. In the absence of an external force, the tapered extension may occupy a neutral and/or biased position relative to the base in one or more of the three orthogonal dimensions.

Figure 3B:
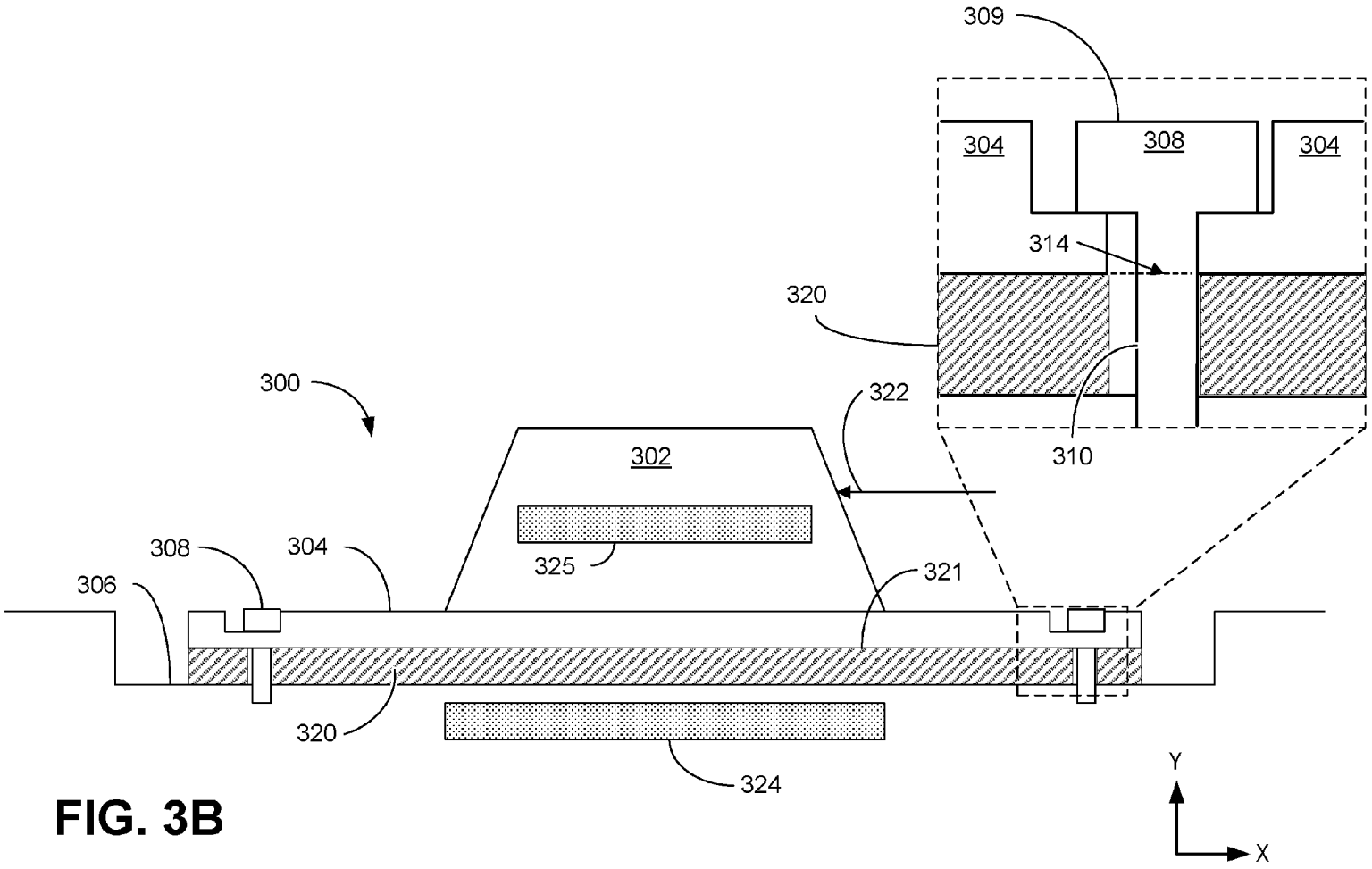

As seen in FIG. 3A, the opening area 316 of each fastener aperture 314 is greater than the latitudinal cross-sectional area 312 of each fastener body 310. As a result, some amount of empty space may surround each fastener body 310. When an external force, such as external force 322 shown in FIG. 3B, is applied to the tapered extension 302, the tapered extension moves relative to the base 306 until a side of the fastener aperture contacts the side of at least one fastener body. In such implementations, each fastener 308 may thereby serve as a stop, limiting the extent to which the platform may move relative to the base. In some examples, the fastener head may contact the side of the fastener aperture, rather than the fastener body. In general, one or more surfaces of platform 304 may contact one or more surfaces of a fastener 308, in order to limit further movement of the tapered extension. This is schematically illustrated in FIG. 3B, in which tapered extension 302 has moved relative to base 306 responsive to application of external force 322, such that platform 304 is contacting each fastener body 310. Latitudinal movement may further be facilitated by movement-facilitating component 321, which may comprise a low-friction surface, as described above.

Figure 3C:
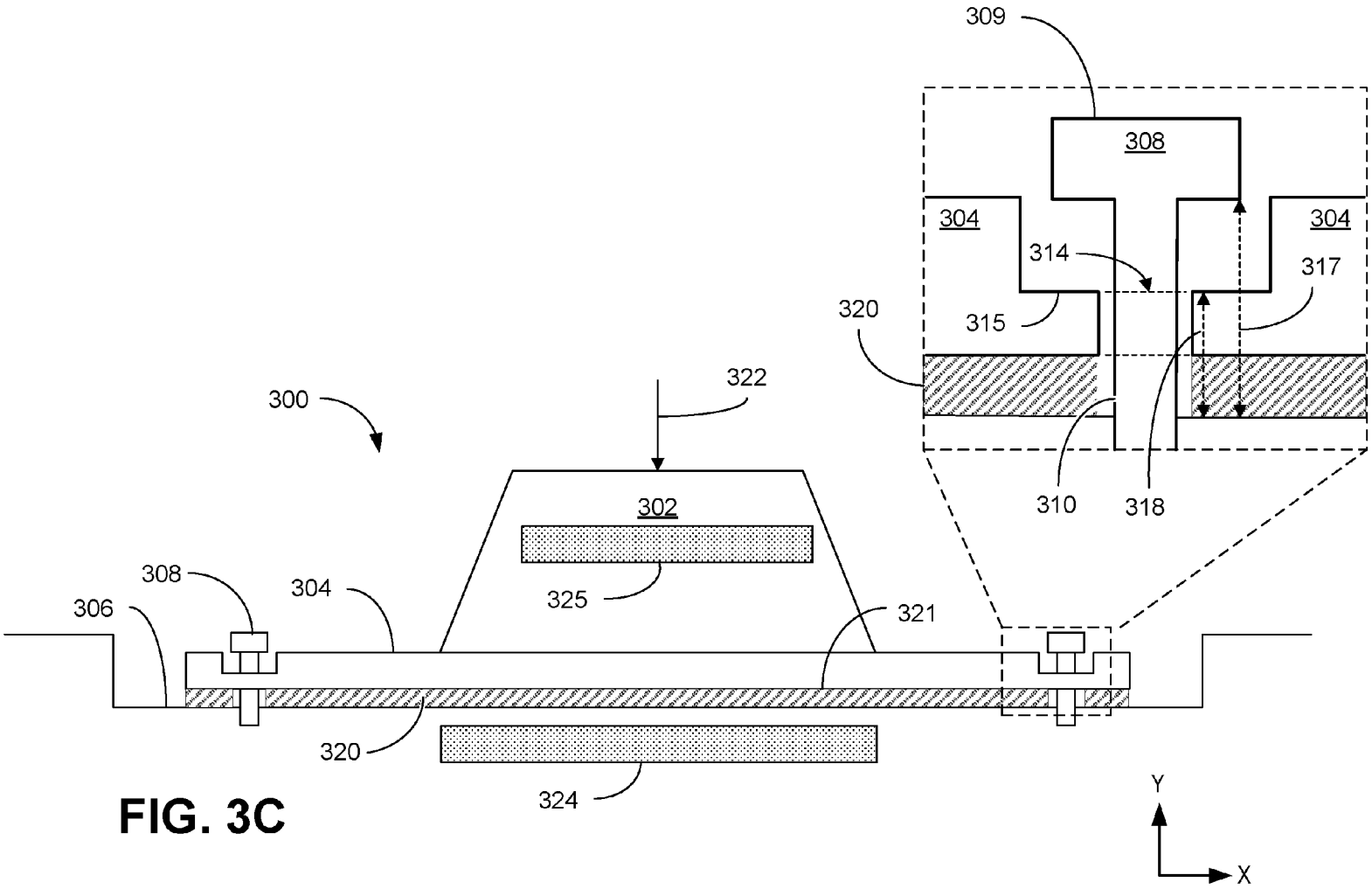

In FIG. 3C, external force 322 is being applied to tapered extension 302 in a longitudinal direction, and as a result tapered extension 302 has moved along the Y coordinate axis, in a longitudinal dimension parallel to a longitudinal axis of each fastener body. As described above, one or more biasing components of tapered extension 302 may be compressible in the longitudinal dimension. This is shown in FIG. 3C, in which external force 322 is applied to biasing component 320 via tapered extension 322, compressing biasing component 320, and moving tapered extension 302 closer to the base in the longitudinal dimension. As a result, the distance between the base and each catch, represented by arrow 318, is now shorter than the distance between the base and each fastener head, represented by arrow 317. In some implementations, a biasing force generated by one or more biasing components of an alignment tolerant electronic connector may oppose any longitudinally oriented external forces. In such implementations, the tapered extension may not move in a longitudinal dimension unless the applied external force has sufficient magnitude to overcome the biasing force.

Figure 3D:
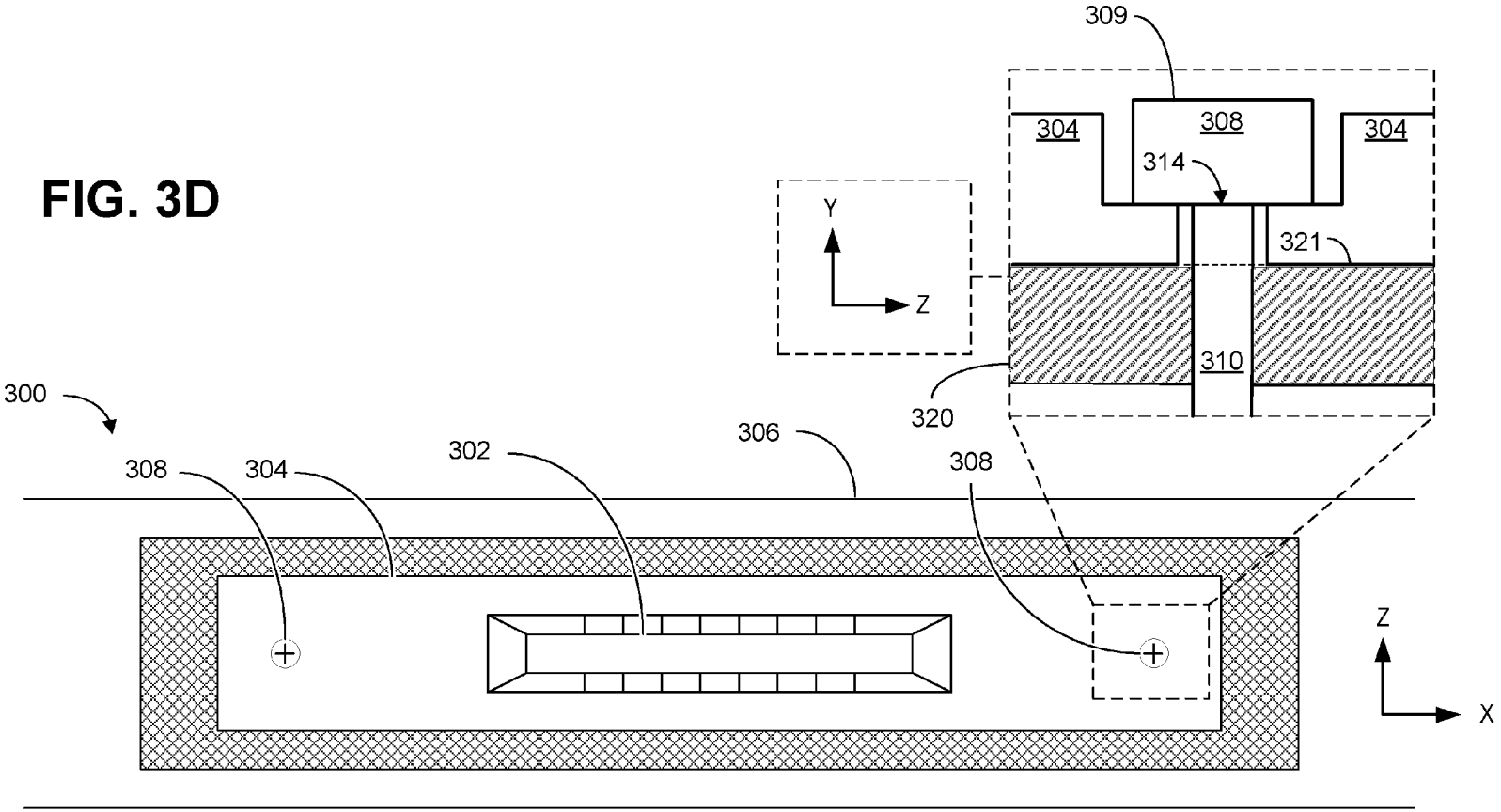
FIGS. 3D and 3E schematically show an example alignment tolerant electronic connector viewed along a Y coordinate axis.

FIG. 3D schematically shows alignment tolerant electronic connector 300 when viewed along a Y coordinate axis. As described above, some amount of empty space is present between each fastener 308 and the sides of each fastener aperture in platform 304. This is clear in FIG. 3D, in which empty space is shown between each fastener 308 and platform 304, along both the X and Z coordinate axes.

Figure 3E:
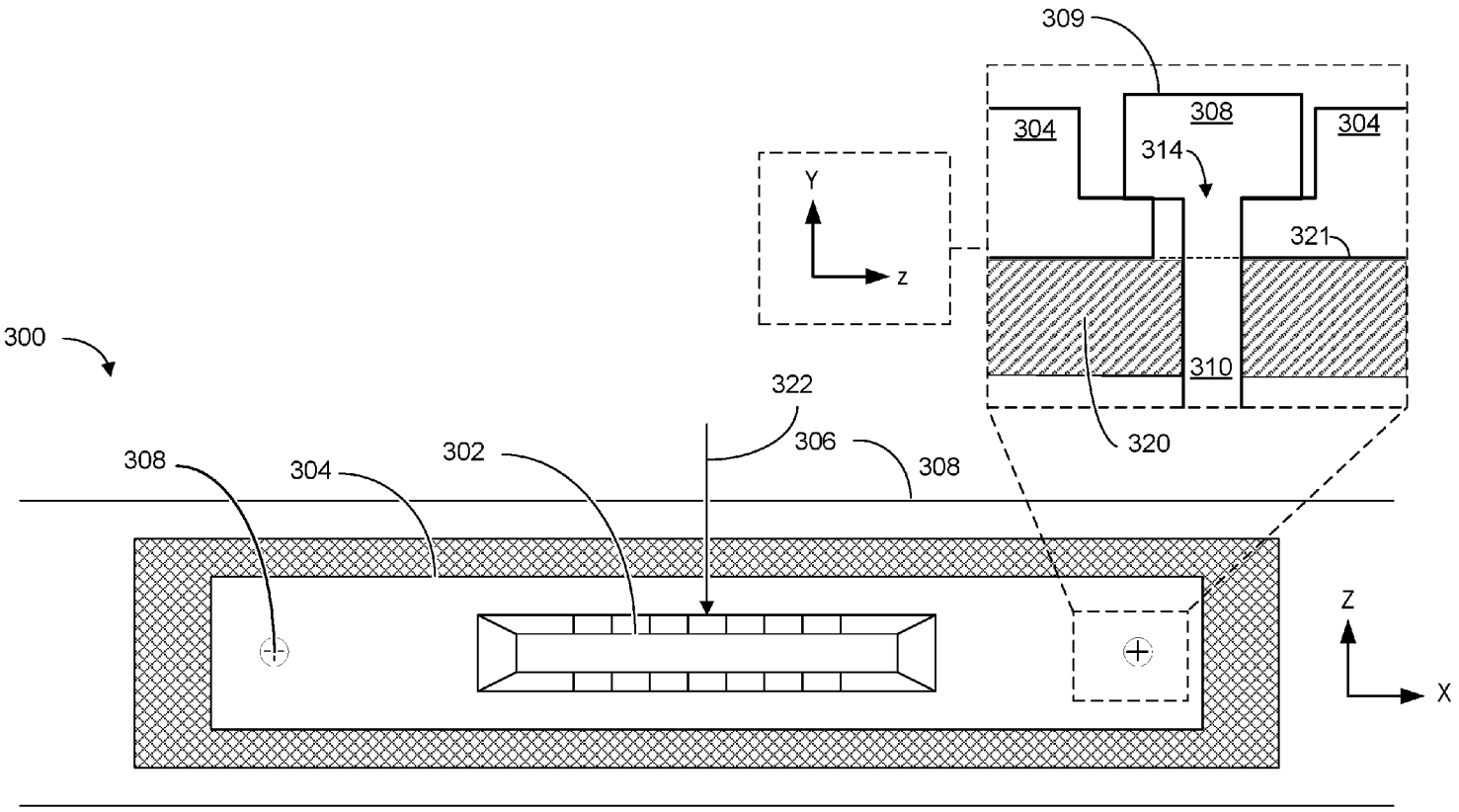

FIG. 3E schematically shows alignment tolerant electronic connector 300, viewed again along the Y coordinate axis, while external force 322 is applied in a latitudinal direction along the Z coordinate axis. As with FIG. 3B, application of external force 322 in a latitudinal direction causes tapered extension 302 to move in a latitudinal dimension until the platform 304 contacts each fastener body 310, preventing further latitudinal motion. Further, application of an external force to the tapered extension, for example during insertion of the tapered extension into a female receptacle, may cause rotation of the tapered extension relative to the base about one or more rotational axes.

An external force, such as external force 322, may have a vector component in one or more of the three orthogonal dimensions. Accordingly, tapered extension 302 may be movable relative to base 306 in multiple dimensions simultaneously.

In some implementations, tapered extension 302 may be movable relative to base 306 by at least 0.5 mm in a first latitudinal dimension. Such a latitudinal dimension may be, for example, along the X coordinate axis. The tapered extension may be movable relative to the base by at least 0.2 mm in a second latitudinal dimension which may be, for example, along the Z coordinate axis. Further, the tapered extension may be movable relative to the base by at least 0.3 mm in a longitudinal dimension, which may be along the Y coordinate axis. Further, in some implementations, a tapered extension may be movable in three additional axes (e.g., pitch, roll, and yaw), when an external force is applied to the tapered extension. For example, an external force applied to the tapered extension away from a center of mass of the tapered extension may cause the tapered extension to rotate along one or more rotational axes relative to the base.

As described above, the tapered extension may occupy a neutral and/or biased position relative to the base when no external force is applied to the tapered extension. As a result, the tapered extension may only move relative to the base responsive to application of an external force of sufficient magnitude. In some implementations, an alignment tolerant joint may include one or more movement-facilitating and/or biasing components which are flexible in one or more dimensions, such that when an external force is removed from the tapered extension, the tapered extension automatically returns to the neutral/biased position.

As described above, an alignment tolerant electronic connector such as electronic connector 300 may be used to communicatively couple two electronic devices. Accordingly, tapered extension 302 may be removably insertable into a female receptacle. In some implementations, the opening of the female receptacle may be wider than a nose, such as nose 204, of the tapered extension. Accordingly, it may be relatively easy to begin inserting the tapered extension into the female receptacle even when the tapered extension and female receptacle are not perfectly aligned. As the tapered extension is inserted further into the female receptacle, one or more surfaces of the tapered extension may contact one or more internal surfaces of the female receptacle, thereby applying an external force, such as external force 322, to the tapered extension. Application of such an external force may cause the tapered extension to move in one or more orthogonal dimensions, as described above, such that the tapered extension automatically aligns with the female receptacle as the tapered extension is inserted further into the female receptacle. This may improve the alignment process, making it easier for a user to safely attach two devices using an electronic connector.

Responsive to insertion of the tapered extension into the female receptacle, the female receptacle may exert an external force on the tapered extension which opposes the biasing force provided by the one or more biasing components. As a result, after insertion into the female receptacle, the tapered extension may retract toward the base in a longitudinal dimension. The one or more biasing components may continue to exert a biasing force on the tapered extension, helping to secure the tapered extension within the female receptacle.

Figure 4:
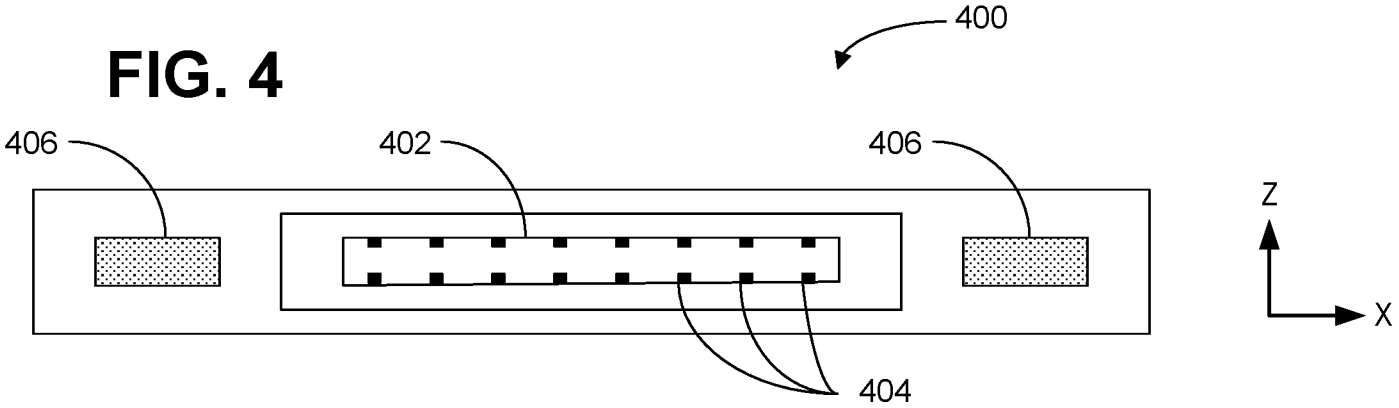
FIG. 4 schematically shows an example female receptacle usable with the example alignment tolerant electronic connectors of FIGS. 2 and 3A-3E.

FIG. 4 schematically shows an example female receptacle 400 viewed along the Y coordinate axis. Female receptacle 400 may be a non-limiting representation of female receptacle 118 as shown in FIG. 1. Female receptacle 400 includes an opening 402, configured to receive a tapered extension, such as tapered extension 302. Female receptacle 400 also may include a plurality of electrical contacts 404. Though eight pairs of electrical contacts 404 are shown in FIG. 4, a female receptacle may include virtually any number of electrical contacts. Electrical contacts 404 may be configured to interface with one or more electrical contacts of a tapered extension when the tapered extension is inserted into the female receptacle. For example, electrical contacts 404 may be configured to interface with electrical contacts 210 as shown in FIG. 2, allowing two devices to exchange electrical power, a ground reference, communication signals, etc. As such, a tapered extension and a corresponding female receptacle may each include the same number of electrical contacts. A female receptacle may further include one or more magnets and/or other magnetically attractable materials. In FIG. 4, female receptacle 400 includes two magnets 406.

Figure 5A:
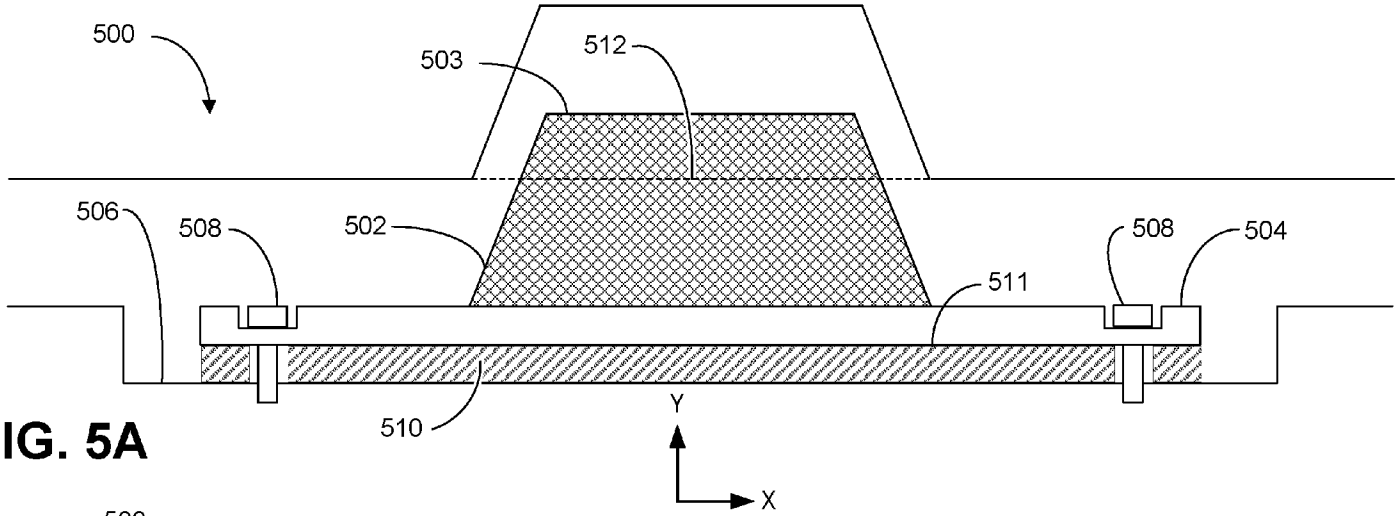
FIGS. 5A and 5B schematically show an example alignment tolerant electronic connector viewed along a Z coordinate axis as a tapered extension is inserted into a female receptacle.
Figure 5B:
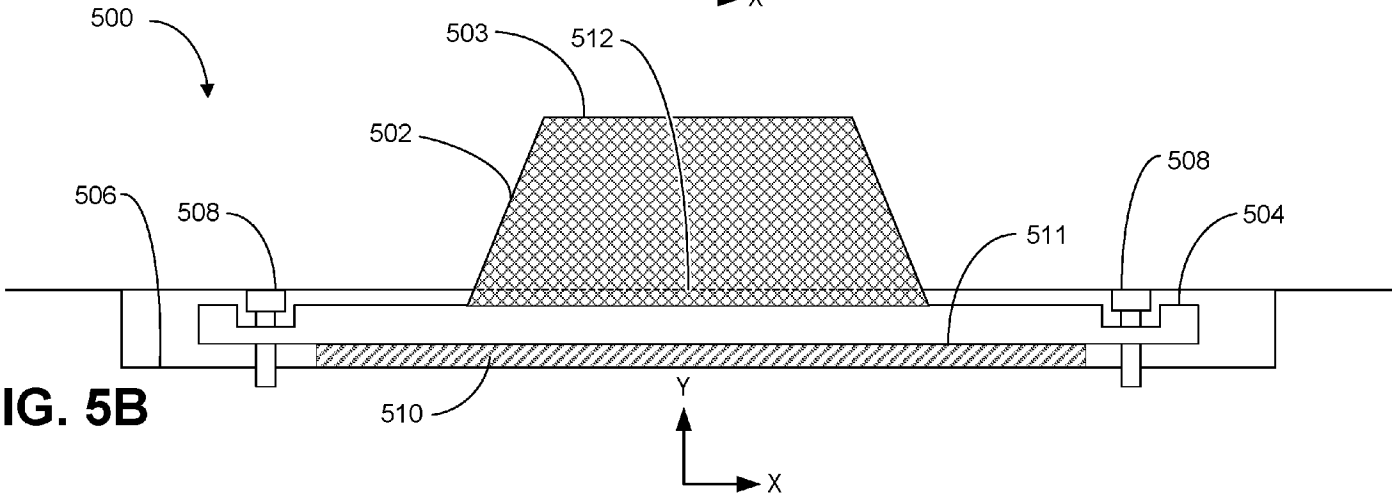

FIGS. 5A and 5B schematically show an example alignment tolerant electronic connector 500 as it is inserted into a female receptacle 512, which may be a non-limiting representation of female receptacle 118 and/or female receptacle 400. Electronic connector 500 includes a tapered extension 502, which includes a nose 503 and a platform 504 and is coupled to a base 506 via an alignment tolerant joint. In FIGS. 5A and 5B, the alignment tolerant joint includes two fasteners 508 and a biasing component 510. The biasing component includes a movement-facilitating component 511, which may take the form of a low-friction surface, as described above.

In FIG. 5A, tapered extension 502 is partially inserted into female receptacle 512. As shown, the opening of female receptacle 512 is somewhat wider than the nose 503 of tapered extension 502. This may allow for partial insertion of tapered extension 502 into female receptacle 512 even when the tapered extension is not completely aligned with the female receptacle. As the tapered extension is inserted further into the female receptacle, an imperfect alignment will cause one or more surfaces of the tapered extension to contact one or more internal surfaces of the female receptacle. This may exert an external force, such as external force 322, on the tapered extension, causing it to move relative to the base until it is properly aligned with the female receptacle.

FIG. 5B schematically shows tapered extension 502 after complete insertion into female receptacle 512. In FIG. 5B, biasing component 510 is shown as being compressed relative to FIG. 5A, and tapered extension 502 has retracted toward base 506. As described above, this may occur because female receptacle 512 exerts an external force in the longitudinal dimension on the tapered extension when the tapered extension is fully inserted into the female receptacle. This external force may cause the tapered extension to move in a longitudinal (and latitudinal) dimension relative to the base, and retract toward the base. The external force applied by the female receptacle may be opposed by a biasing force provided by biasing component 510, helping to secure tapered extension 502 within female receptacle 512.

Figure 6:
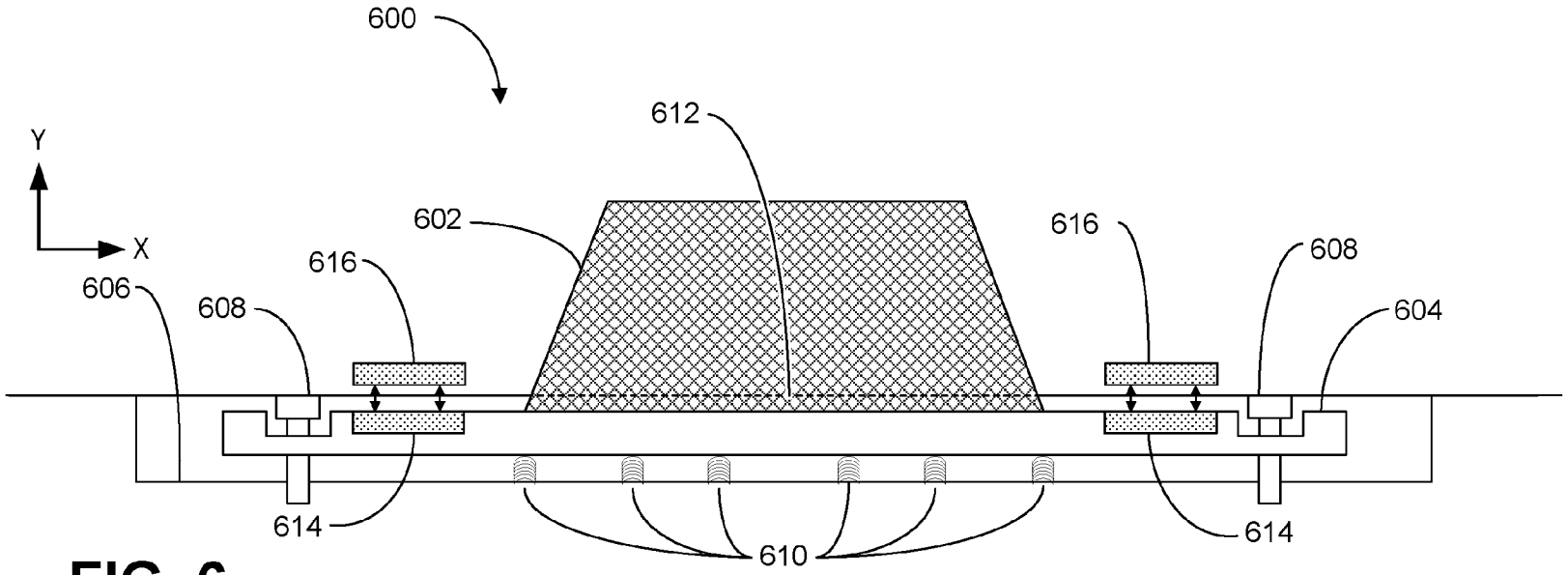
FIG. 6 schematically shows an example alignment tolerant electronic connector viewed along a Z coordinate axis.

FIG. 6 schematically shows an example alignment tolerant electronic connector 600, including a tapered extension 602. Tapered extension 602 may be a non-limiting representation of tapered extension 116 as shown in FIG. 1 and/or tapered extension 200 as shown in FIG. 2. Tapered extension includes a platform 604, which is coupled to a base 606 via an alignment tolerant joint. In FIG. 6, the alignment tolerant joint includes two fasteners 608, and a number of biasing components 610. Biasing components 610 may take the form of springs compressible and/or deflectable in one or more of the three orthogonal dimensions, and may be composed of any suitable material or combinations of materials (flexible plastics, various metal alloys, etc.). Additionally magnets that are oriented such that they provide a repulsive force could also be used to create compliance and act as a compliant member. Any suitable number of springs, and/or other movement-facilitating components may be included in an alignment tolerant joint to couple a tapered extension to a base.

As with biasing component 320 shown in FIG. 3, biasing components 610 may be compressible in a longitudinal dimension, allowing tapered extension 602 to move in a longitudinal dimension relative to the base responsive to an external force applied to the tapered extension. Further, each biasing component 610 may be flexible in one or more latitudinal dimensions, allowing tapered extension 602 to move in one or more latitudinal dimensions responsive to an external force applied to the tapered extension (which allows for any misalignment between the two mating bodies).

In some implementations, an alignment tolerant electronic connector may include one or more magnets and/or other magnetically attractable materials which are configured to secure the tapered extension within a female receptacle via magnetic interaction with one or more magnetically attractable materials coupled to the female receptacle. In FIG. 6, tapered extension 602 is shown inserted into a female receptacle 612, which may be a non-limiting representation of female receptacle 118 as shown in FIG. 1 and/or female receptacle 400 as shown in FIG. 4. Alignment tolerant electronic connector 600 includes two magnets 614, configured to magnetically attract two magnets 616 attached to the female receptacle. Such magnetic attraction may provide a magnetic force which helps augment a biasing force provided by one or more biasing components. The magnetic force may further help to align the tapered extension with the female receptacle as the tapered extension is brought into proximity with the female receptacle.

In some implementations, a female receptacle, such as female receptacle 118, female receptacle 400, female receptacle 512, and/or female receptacle 612, may be movable and/or rotatable along a plurality of axes in a substantially similar manner to the tapered extensions described above. For example, female receptacle 118 may in some implementations be movable relative to first portion 102 in a substantially similar manner as tapered extension 116 is movable relative to second portion 104. Any and/or all of the above-described structures, joints, fasteners, techniques, and mechanisms may be applied to a female receptacle in addition to or in lieu of the above-described tapered extensions. Accordingly, in some implementations, a fixed tapered extension may be removably insertable into a movable female receptacle. Alternatively, a movable tapered extension, such as those described above, may be removably insertable into a movable female receptacle.

Figure 7A:
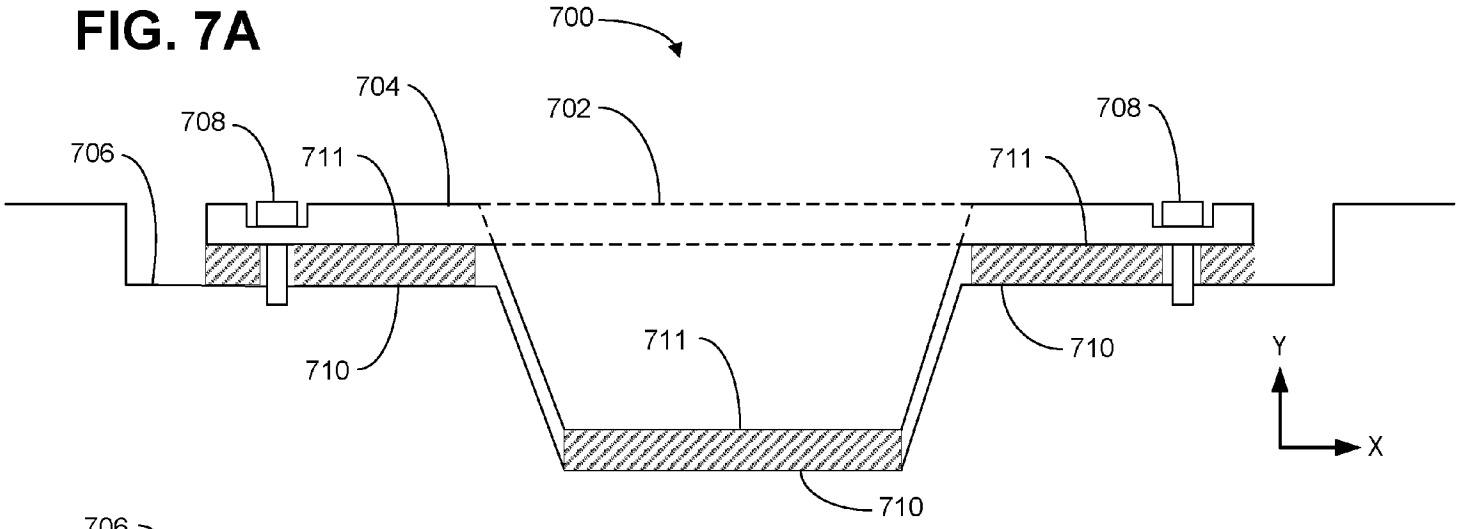
FIG. 7A schematically shows an example alignment tolerant electronic connector viewed along a Z coordinate axis.
Figure 7B:
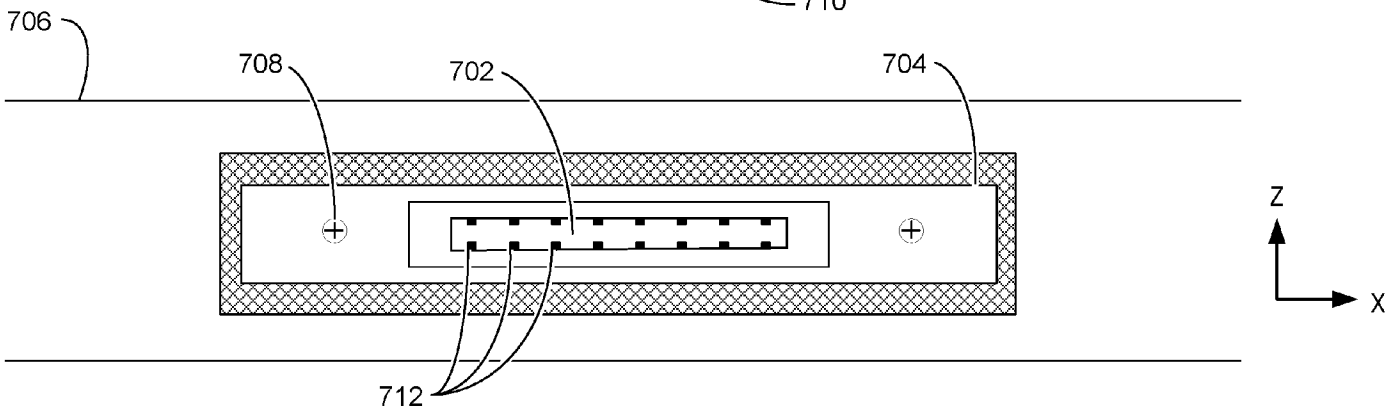
FIG. 7B schematically shows an example alignment tolerant electronic connector viewed along a Y coordinate axis.

FIGS. 7A and 7B schematically show an example alignment tolerant electronic connector 700. As with FIGS. 3A-3E, components shown in FIGS. 7A and 7B may not be drawn to scale. FIGS. 7A and 7B are only intended to illustrate the general relationships between components of an example alignment tolerant electronic connector. Electronic connector 700 includes a female receptacle 702, which includes a platform 704. Female receptacle 702 may represent a non-limiting alternative to any of the female receptacles described above.

Female receptacle 702 is coupled to a base 706 via an alignment tolerant joint. In this example, the alignment tolerant joint includes two fasteners 708 affixing platform 704 to base 706. Similar to fasteners 308, fasteners 708 each have a fastener head and a fastener body. The general relationships between fasteners 708, base 706, and platform 704 may be substantially similar to the general relationships between fasteners 308, base 306, and platform 304. As a result, the female receptacle may be movable relative to the base in three orthogonal dimensions, and/or may be rotatable relative to the base about three rotational axes responsive to application of an external force. Such an external force may be applied during insertion of a tapered extension into female receptacle 702. Misalignment between the tapered extension and female receptacle 702 during insertion may result in the application of an external force to the tapered extension when one or more surfaces of the female receptacle contact one or more surfaces of the tapered extension, causing the female receptacle to move relative to the base until the female receptacle achieves proper alignment with the tapered extension.

Only one female receptacle 702 is shown in FIG. 7A. However, in some examples multiple female receptacles may each share a common platform 704, affixed to base 706 via fasteners 708. In such examples, movement of the platform may result in equal movement of each female receptacle sharing the platform. Additionally or alternatively, a computing device, such as computing device 100, may utilize a number of alignment tolerant electronic connectors, such as electronic connector 700, each electronic connector having at least one female receptacle which is coupled to a base via an alignment tolerant joint.

In some implementations, other fasteners besides fasteners 708 may be used to affix a female receptacle to a base. For example, a base could be constructed which has a recess which is partially occluded by one or more shelves. A female receptacle including a platform could be partially disposed within the recess, though sized such that it cannot pass the shelves occluding the recess. In such an implementation, the shelves may serve as fasteners. Alternatively, an implementation could utilize similar fasteners to fasteners 708, though flipped such that each fastener body is inserted into platform 706, and each fastener head is inserted into a recess in the base defined by a catch. Other implementations may utilize one or more hooks, posts, screws, bolts, etc. In general, virtually any combination of structures, fasteners, mechanisms, and/or other features may be included in an alignment tolerant joint to movably affix a female receptacle to a base.

As shown, electronic connector 700 includes biasing component(s) 710. Platform 704 may interface with biasing component(s) 710 via a movement-facilitating component (s) 711, which may take the form of a low-friction surface of the biasing component(s), allowing the platform to move in one or more latitudinal dimensions relative to the movement facilitating component(s) (e.g., along X axis and/or Z axis). The biasing component(s) may be compressible in a longitudinal dimension parallel to a longitudinal axis of each fastener body (e.g., along the Y axis), and generate a biasing force which biases female receptacle 702 away from base 706. The biasing component(s) may be composed of a synthetic foam material with spring-like properties. For example, the biasing component(s) may be composed of a closed-cell urethane or silicone foam, though other materials may instead be utilized. Alternatively, the biasing component(s) may be a magnet, and/or include one or more magnetic components configured to repel one or more magnets located within the female receptacle, thereby generating the biasing force. The biasing component(s) may be composed of a material which naturally has a low coefficient of friction, thus independently functioning as a movement-facilitating component(s), and/or the biasing component(s) may cooperate with one or more additional substances in order to provide the movement-facilitating component(s) 711 that contacts platform 704. For example, the biasing component(s) may be coated in a plastic film which has a low coefficient of friction.

In other implementations, an alternate alignment tolerant electronic connector may include one or more springs which serve as biasing components. In some implementations, rollers and/or ball bearings may be used as movement-facilitating components. An alignment tolerant joint may use virtually any components and/or combinations of materials in order to allow a female receptacle to move within a limited range relative to a base.

FIG. 7B schematically shows alignment tolerant electronic connector 700 when viewed along a Y coordinate axis. Similar to electronic connector 300, some amount of empty space is present between each fastener 708 and the sides of each fastener aperture in platform 704. This may allow the female receptacle to move relative to the base in one or more latitudinal dimensions (e.g., an X dimension and a Z dimension). Female receptacle 702 also may include a plurality of electrical contacts 712. Though eight pairs of electrical contacts 712 are shown in FIG. 7B, a female receptacle may include virtually any number of electrical contacts. Electrical contacts 712 may be configured to interface with one or more electrical contacts of a tapered extension when the tapered extension is inserted into the female receptacle. For example, electrical contacts 712 may be configured to interface with electrical contacts 210 as shown in FIG. 2, allowing two devices to exchange electrical power, a ground reference, communication signals, etc. As such, a tapered extension and a corresponding female receptacle may each include the same number of electrical contacts. A female receptacle may further include one or more magnets and/or other magnetically attractable materials.

In an example, an electronic connector comprises: a base; a tapered extension including a platform and a plurality of electrical contacts; an alignment tolerant joint coupling the tapered extension to the base, the tapered extension movable relative to the base in three orthogonal dimensions responsive to an external force applied to the tapered extension; and one or more biasing components biasing the tapered extension away from the base. In this example or any other example, the tapered extension is moveable in one or more dimensions relative to the base responsive to one or more forces applied to the tapered extension by a female receptacle as the tapered extension is inserted into the female receptacle. In this example or any other example, responsive to insertion of the tapered extension into the female receptacle, the tapered extension retracts toward the base in a longitudinal dimension, the tapered extension being secured within the female receptacle by a biasing force provided by the one or more biasing components. In this example or any other example, the alignment tolerant joint includes one or more fasteners affixing the platform to the base, each fastener having a fastener body and a fastener head, each fastener head having a latitudinal cross-sectional area greater than a latitudinal cross-sectional area of each fastener body. In this example or any other example, the alignment tolerant joint includes a movement-facilitating component having a low-friction surface, the movement-facilitating component disposed between the base and the platform. In this example or any other example, one or more of the biasing components is the movement-facilitating component, and is compressible in a longitudinal dimension parallel to a longitudinal axis of each fastener body. In this example or any other example, the movement-facilitating component is composed of a synthetic foam material. In this example or any other example, the alignment tolerant joint includes one or more springs compressible in one or more of the three orthogonal dimensions. In this example or any other example, the electronic connector further comprises one or more magnets configured to secure the tapered extension within a female receptacle via magnetic interaction with magnetically attractable materials coupled to the female receptacle. In this example or any other example, the one or more fasteners are inserted through one or more fastener apertures, each fastener aperture defined by a catch in the platform and having an opening area which is greater than the latitudinal cross-sectional area of each fastener body and smaller than the latitudinal cross-sectional area of each fastener head, allowing the tapered extension to move in one or more latitudinal dimensions perpendicular to a longitudinal axis of each fastener body. In this example or any other example, a distance between the base and each fastener head is greater than a distance between the base and each catch when the external force is applied to the tapered extension along a longitudinal dimension parallel to a longitudinal axis of each fastener body. In this example or any other example, the tapered extension is movable by at least 0.5 mm relative to the base in a first latitudinal dimension, by at least 0.2 mm relative to the base in a second latitudinal dimension, and 0.3 mm relative to the base in a longitudinal dimension. In this example or any other example, the tapered extension includes: a nose forming a terminal end of the tapered extension; a first connection face; a second connection face, the first connection face and the second connection face tapering toward each other from the platform to the nose symmetrically about a symmetry plane; and where a first set of the plurality of electrical contacts are located along the first connection face and a second set of the plurality of electrical contacts are located along the second connection face.

In an example, an electronic connector comprises: a base; a tapered extension, including: a nose forming a terminal end of the tapered extension; a first connection face; and a second connection face, the first connection face and the second connection face tapering toward each other from the base to the nose symmetrically about a symmetry plane; where a first set of a plurality of electrical contacts are located along the first connection face and a second set of the plurality of electrical contacts are located along the second connection face; and an alignment tolerant joint coupling the tapered extension to the base, the tapered extension movable in three orthogonal dimensions relative to the base responsive to an external force applied to the tapered extension. In this example or any other example, the alignment tolerant joint includes one or more fasteners affixing the platform to the base, each fastener having a fastener body and a fastener head, each fastener head having a latitudinal cross-sectional area greater than a latitudinal-cross sectional area of each fastener body. In this example or any other example, the alignment tolerant joint includes a movement-facilitating component having a low-friction surface, the movement-facilitating component disposed between the base and the platform. In this example or any other example, the movement-facilitating component is compressible in a longitudinal dimension parallel to a longitudinal axis of each fastener body, and biases the tapered extension away from the base.

In an example, a computing device comprises: a first portion that includes a display screen; a second portion that includes an input device and that is separably connected to the first portion; a locking mechanism configured to lock the first portion to the second portion, the locking mechanism including at least one locking receptacle connected to the first portion and at least one locking protrusion connected to the second portion; and an electronic connector configured to allow electronic communication between the first and second portions, the electronic connector comprising: a female receptacle including a plurality of electrical contacts and connected to the first portion; and a tapered extension including a plurality of electrical contacts configured to interface with the electrical contacts of the female receptacle when inserted into the female receptacle, and the tapered extension moveably coupled to the second portion via an alignment tolerant joint such that the tapered extension is movable in three orthogonal dimensions relative to the second portion. In this example or any other example, the electronic connector further comprises one or more biasing components biasing the tapered extension away from the second portion. In this example or any other example, the alignment tolerant joint includes a movement-facilitating component having a low-friction surface, the movement-facilitating component disposed between the second portion and the tapered extension.

It will be understood that the configurations and/or approaches described herein are exemplary in nature, and that these specific implementations or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A computing device, comprising:

a first portion that includes a display screen;

a second portion that includes an input device and that is separably connected to the first portion;

a locking mechanism configured to lock the first portion to the second portion, the locking mechanism including at least one locking receptacle connected to the first portion and at least one locking protrusion connected to the second portion; and an electronic connector configured to allow electronic communication between the first and second portions, the electronic connector comprising:

a female receptacle including a plurality of electrical contacts and connected to the first portion; and a tapered extension including a plurality of electrical contacts configured to interface with the electrical contacts of the female receptacle when inserted into the female receptacle, and the tapered extension moveably coupled to the second portion via an alignment tolerant joint such that the tapered extension is movable in three orthogonal dimensions relative to the second portion.

2. The computing device of claim 1, where the electronic connector further comprises one or more biasing components biasing the tapered extension away from the second portion.

3. The computing device of claim 2, where the alignment tolerant joint includes a movement-facilitating component having a low-friction surface, the movement-facilitating component disposed between the second portion and the tapered extension.

4. A computing device, comprising:
a first portion that includes a display screen;
a second portion that includes an input device and that is separably connected to the first portion; and
an electronic connector configured to allow electronic communication between the first and second portions, the electronic connector comprising:
a female receptacle connected to the first portion;
a base connected to the second portion;
a tapered extension connected to the base including a platform and a plurality of electrical contacts;
an alignment tolerant joint coupling the tapered extension to the base, the tapered extension movable relative to the base in three orthogonal dimensions responsive to an external force applied to the tapered extension; and
one or more biasing components biasing the tapered extension away from the base.

5. The computing device of claim 4, where the tapered extension is moveable in one or more dimensions relative to the base responsive to one or more forces applied to the tapered extension by the female receptacle as the tapered extension is inserted into the female receptacle.

6. The computing device of claim 5, where responsive to insertion of the tapered extension into the female receptacle, the tapered extension retracts toward the base in a longitudinal dimension, the tapered extension being secured within the female receptacle by a biasing force provided by the one or more biasing components.

7. The computing device of claim 4, where the alignment tolerant joint includes one or more fasteners affixing the platform to the base, each fastener having a fastener body and a fastener head, each fastener head having a latitudinal cross-sectional area greater than a latitudinal cross-sectional area of each fastener body.

8. The computing device of claim 7, where the alignment tolerant joint includes a movement-facilitating component having a low-friction surface, the movement-facilitating component disposed between the base and the platform.

9. The computing device of claim 8, where one or more of the biasing components is the movement-facilitating component, and is compressible in a longitudinal dimension parallel to a longitudinal axis of each fastener body.

10. The computing device of claim 9, where the movement-facilitating component is composed of a synthetic foam material.

11. The computing device of claim 7, where the one or more fasteners are inserted through one or more fastener apertures, each fastener aperture defined by a catch in the platform and having an opening area which is greater than the latitudinal cross-sectional area of each fastener body and smaller than the latitudinal cross-sectional area of each fastener head, allowing the tapered extension to move in one or more latitudinal dimensions perpendicular to a longitudinal axis of each fastener body.

12. The computing device of claim 11, where a distance between the base and each fastener head is greater than a distance between the base and each catch when the external force is applied to the tapered extension along a longitudinal dimension parallel to a longitudinal axis of each fastener body.

13. The computing device of claim 4, where the tapered extension is movable by at least 0.5 mm relative to the base in a first latitudinal dimension, by at least 0.2 mm relative to the base in a second latitudinal dimension, and 0.3 mm relative to the base in a longitudinal dimension.

14. The computing device of claim 4, where the tapered extension includes:
a nose forming a terminal end of the tapered extension;
a first connection face;
a second connection face, the first connection face and the second connection face tapering toward each other from the platform to the nose symmetrically about a symmetry plane; and
where a first set of the plurality of electrical contacts are located along the first connection face and a second set of the plurality of electrical contacts are located along the second connection face.

15. A computing device, comprising:
a first portion that includes a display screen;
a second portion that includes an input device and that is separably connected to the first portion; and
an electronic connector configured to allow electronic communication between the first and second portions, the electronic connector comprising:
a female receptacle connected to the first portion;
a base connected to the second portion;
a tapered extension connected to the base, including:
a platform;
a nose forming a terminal end of the tapered extension;
a first connection face; and
a second connection face, the first connection face and the second connection face tapering toward each other from the base to the nose symmetrically about a symmetry plane;
where a first set of a plurality of electrical contacts are located along the first connection face and a second set of the plurality of electrical contacts are located along the second connection face; and
an alignment tolerant joint coupling the tapered extension to the base, the tapered extension movable in three orthogonal dimensions relative to the base responsive to an external force applied to the tapered extension.

16. The computing device of claim 15, where the alignment tolerant joint includes one or more fasteners affixing the platform to the base, each fastener having a fastener body and a fastener head, each fastener head having a latitudinal cross-sectional area greater than a latitudinal-cross sectional area of each fastener body.

17. The computing device of claim 16, where the alignment tolerant joint includes a movement-facilitating component having a low-friction surface, the movement-facilitating component disposed between the base and the platform.

18. The computing device of claim 17, where the movement-facilitating component is compressible in a longitudinal dimension parallel to a longitudinal axis of each fastener body, and biases the tapered extension away from the base.

* * * * *